US008128417B2

(12) United States Patent
Schonig

(10) Patent No.: US 8,128,417 B2
(45) Date of Patent: Mar. 6, 2012

(54) METHODS AND APPARATUS FOR CONNECTING PRINTED CIRCUIT BOARDS USING ZERO-INSERTION WIPING FORCE CONNECTORS

(75) Inventor: Frank Schonig, Los Gatos, CA (US)

(73) Assignee: Teradyne, Inc., North Reading, MA (US)

( * ) Notice: Subject to any disclaimer, the term of this patent is extended or adjusted under 35 U.S.C. 154(b) by 396 days.

(21) Appl. No.: 12/563,319

(22) Filed: Sep. 21, 2009

(65) Prior Publication Data

US 2011/0070748 A1 Mar. 24, 2011

(51) Int. Cl.
*H01R 12/00* (2006.01)
*H01R 13/15* (2006.01)

(52) U.S. Cl. ..... 439/65; 439/259; 439/310

(58) Field of Classification Search ..... 439/65, 439/259, 310

See application file for complete search history.

(56) References Cited

U.S. PATENT DOCUMENTS

| | | | | | |
|---|---|---|---|---|---|
| 3,495,132 | A | * | 2/1970 | Anhalt et al. | 439/259 |
| 4,470,100 | A | * | 9/1984 | Rebaudo et al. | 439/310 |
| 4,560,221 | A | * | 12/1985 | Olsson | 439/260 |
| 4,587,596 | A | * | 5/1986 | Bunnell | 439/67 |
| 4,629,270 | A | | 12/1986 | Andrews, Jr. et al. | |
| RE033,604 | E | | 6/1991 | Gillett et al. | |
| 5,073,125 | A | * | 12/1991 | Hashiguchi et al. | 439/310 |
| 5,248,262 | A | * | 9/1993 | Busacco et al. | 439/66 |
| 5,696,353 | A | * | 12/1997 | Kanno | 439/493 |
| 5,989,038 | A | | 11/1999 | Jesman et al. | |
| 6,129,573 | A | | 10/2000 | Juntwait et al. | |
| 6,692,272 | B2 | | 2/2004 | Lemke et al. | |
| 7,104,825 | B2 | * | 9/2006 | Kajiwara | 439/259 |
| 7,291,032 | B1 | * | 11/2007 | Carver et al. | 439/310 |
| 7,458,854 | B1 | | 12/2008 | Morgan | |
| 7,713,077 | B1 | * | 5/2010 | McGowan et al. | 439/249 |
| 7,722,375 | B2 | * | 5/2010 | Hagen et al. | 439/310 |
| 2007/0021004 | A1 | | 1/2007 | Laurx et al. | |

FOREIGN PATENT DOCUMENTS

| | | | |
|---|---|---|---|
| EP | 0571037 | A1 | 11/1993 |
| EP | 1143571 | A2 | 10/2001 |
| EP | 1149436 | B1 | 10/2001 |
| WO | 2009061415 | A2 | 5/2009 |

* cited by examiner

*Primary Examiner* — Briggitte R Hammond
(74) *Attorney, Agent, or Firm* — BainwoodHuang

(57) ABSTRACT

A circuit board assembly includes a primary board, and a connector mounted to a mounting location of the primary board. The connector includes compliant conductors, each compliant conductor having a first end and a second end. The connector further includes a connector body supported by the primary board. The connector body constrains the first end of each compliant conductor at the mounting location and the second end of each compliant conductor at an interface location. The connector further includes a movable member which is capable of moving relative to the connector body along an axis extending between the mounting location and the interface location. The movable member is constructed and arranged to control tension of the compliant conductors while the connector body constrains the first end of each compliant conductor at the mounting location and the second end of each compliant conductor at the interface location.

14 Claims, 4 Drawing Sheets

METHODS AND APPARATUS FOR CONNECTING PRINTED CIRCUIT BOARDS USING ZERO-INSERTION WIPING FORCE CONNECTORS

BACKGROUND

A conventional approach to connecting two circuit board modules at a right angle to each other involves mating together respective connectors of the modules. For example, in an X-Y-Z coordinate system, suppose that a first module is oriented in the Y-Z plane, and has a first connector (e.g., a male connector) disposed generally near its center. Additionally, suppose that a second module is oriented in the X-Z plane and has a second connector (e.g., a female connector) disposed along its leading edge. As a result, the two modules are at a right angle to each other, with the leading edge of the second module nearest to the first module and with the respective connectors facing each other along the X-axis.

To connect the circuit board modules together, a user moves the second module toward the first module (e.g., the leading edge of the second module moves in the positive X-direction toward the first module). Eventually, the pins of the connectors make electrical contact and begin wiping against each other. The user applies substantial insertion force to enable the pins of the connectors to continue wiping against each other until the connectors are fully engaged.

To disconnect the circuit board modules from each other, the user moves the second module away from the first module (e.g., the leading edge of the second modules moves in the negative X-direction away from the first module). The user applies enough force (e.g., similar to the amount of insertion force) to enable the pins of the connectors to wipe against each other in the opposite direction as the connectors start to disengage. Finally, the connectors separate thus disconnecting the modules.

SUMMARY

Unfortunately, there are deficiencies to the above-described conventional approach to connecting two circuit board modules at a right angle. For example, there is a risk of bending one or more connector pins as the male and female connectors engage each other. Once a pin of a connector is bent, the connector must be replaced thus imposing a repair burden on the user (e.g., complicated circuit board rework).

Similarly, routine wiping between pins causes the pins to wear out over time. Eventually, the pin finish and/or the pin material of the connectors may become so worn or cluttered with metallic debris that it is necessary to replace the connector in order to prevent creation of a reliability concern.

Additionally, during connector engagement and disengagement, stresses between the connectors tend to cause stresses and fatigue between the connectors and their respective circuit boards. In particular, during connector engagement, frictional resistance between the connectors as the connector mate with each other tends to strain the connections between the connectors and circuit boards in one direction. Furthermore, during connector disengagement, the frictional resistance between the connectors as the connectors pull away from each other strains the connections between the connectors and the circuit boards in the opposite direction. Eventually, the connections between the connectors and the circuit boards, and the adjacent circuit board traces can weaken and perhaps fail.

In contrast to the above-described conventional approach to connecting circuit board modules at right angles using male and female connectors which require substantial insertion force, improved connecting techniques utilize a zero-insertion wiping force (ZiWF) connecting device (or connector) to connect two circuit boards. Such a ZiWF connector requires little if any force to establish a robust and reliable electrical connection. Accordingly, there is less wear on the connector and less strain between the connector and the circuit board thus improving reliability and longevity among the various components.

One embodiment is directed to a circuit board assembly having a primary board, and a connector (e.g., a ZiWF connecting device) mounted to a mounting location of the primary board. The connector includes compliant conductors, each compliant conductor having a first end and a second end. The connector further includes a connector body supported by the primary board. The connector body constrains the first end of each compliant conductor at the mounting location and the second end of each compliant conductor at an interface location. The connector further includes a movable member which is capable of moving relative to the connector body along an axis extending between the mounting location and the interface location. The movable member is constructed and arranged to control tension of the compliant conductors while the connector body constrains the first end of each compliant conductor at the mounting location and the second end of each compliant conductor at the interface location. Such an embodiment is able to improving reliability and longevity in systems which involve routine removal and/or replacement of a circuit board such as device under test (DUT) board servicing in the context of automated test equipment (ATE).

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

An improved connecting technique utilizes a zero-insertion wiping force (ZiWF) connector to electrically connect two printed circuit boards (PCBs). Such a ZiWF connector requires little if any force to establish a robust and reliable electrical connection. As a result, there is less connector wear and less strain between the connector and the circuit board thus improving reliability and longevity among the various components.

Figure 1:
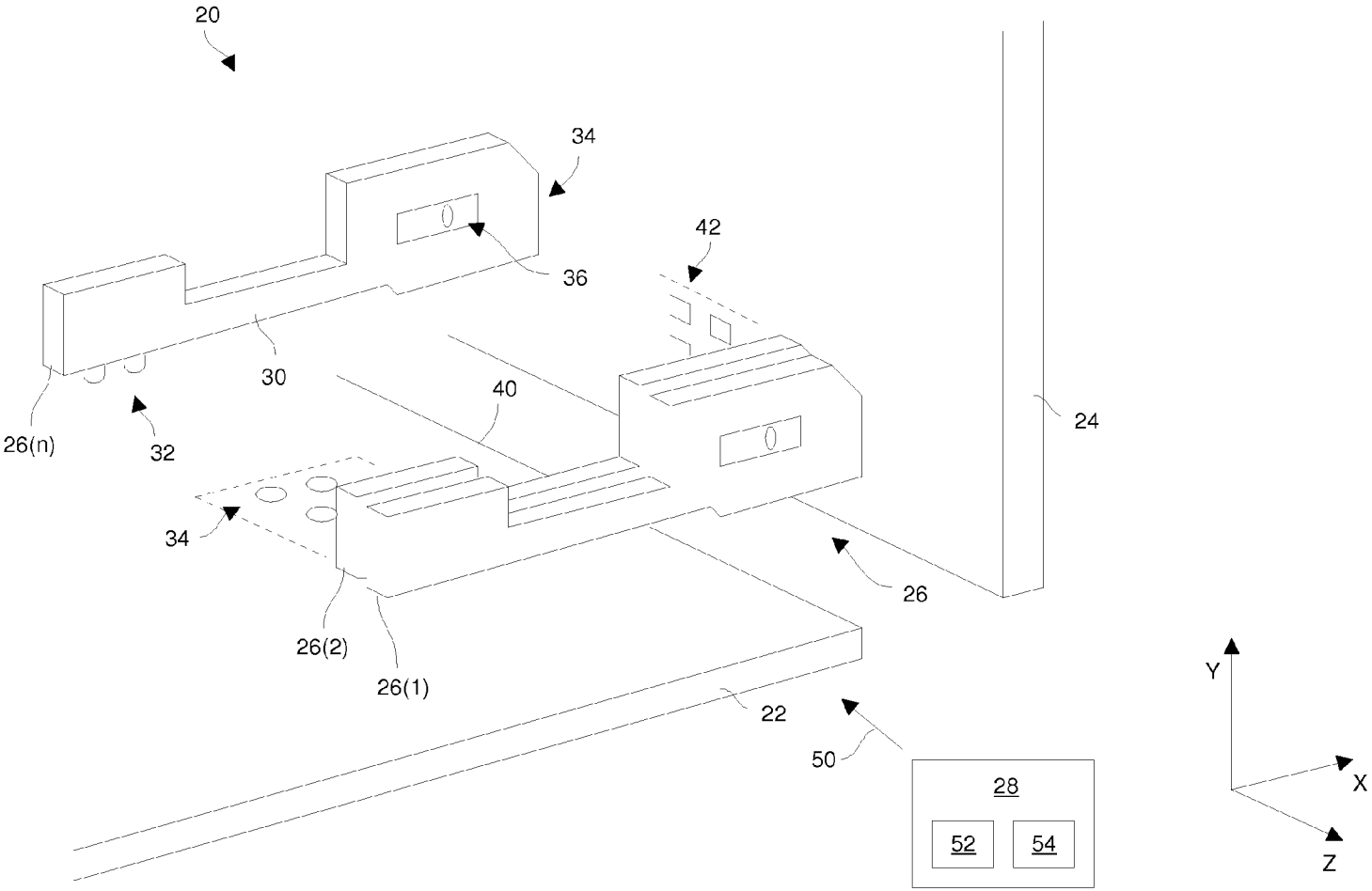
FIG. 1 is a perspective view of a portion of an electronic system which utilizes zero-insertion wiping force connecting devices.

FIG. 1 shows a portion of an electronic system 20 which utilizes ZiWF connecting techniques. The electronic system 20 includes a primary printed circuit board (PCB) 22, a target PCB 24, a set of connectors 26(1), 26(2), . . . , 26(*n*) (collectively, connectors 26), and a controller 28. Each connector 26 (e.g., see the connector 26(*n*)) includes a connector body 30, a set of contacts 32 for electrically connecting to the primary PCB 22, a set of contacts 34 for electrically connecting to the target PCB 24, and an actuation mechanism 36 which controls operation of the connector 26. As will be described in further detail shortly, the controller 28 is constructed and arranged to actuate each connector 26 in a manner that results in application of a minimal amount of wiping force to the target PCB 24 during connection thus reducing wear and tear between the connector 26 and the target PCB 24.

As shown in FIG. 1, the primary PCB 22 extends substantially in a plane (e.g., the X-Z plane). The primary PCB 22 provides rigid support for a variety of other circuit board components (e.g., integrated circuits, discrete components, etc, which are not shown in FIG. 1 for simplicity) and for the connectors 26 which extend in a row along an edge 40 of the primary PCB 22, i.e., parallel to the Z-axis. The electrical contacts 32 of the connectors 26 are constructed and arranged to electrically connect to complimentary electrical contacts 34 of the primary PCB 22 in a substantially long-lasting manner. In some arrangements, the primary PCB 22 and the connectors 26, perhaps along with other parts, form a circuit board assembly which is rarely (if ever) dismantled as a unit. It should be understood that additional hardware can be provided to mechanically attach and physically support the connector bodies 30 of the connectors 26 relative to the primary PCB 22. By way of example only, the contacts 32 of the connector 26 are compression fit pins and the contacts 34 of the primary PCB 22 are plated through holes (PTHs).

As further shown in FIG. 1, the target PCB 24 extends substantially in a plane (e.g., the Y-Z plane). The electrical contacts 34 of the connectors 26 are constructed and arranged to electrically connect to complimentary electrical contacts 42 of the target PCB 24. Preferably, the contacts 34 of the connectors 26 are probe-like conductor ends and the contacts 42 of the target PCB 24 are metallic surfaces, e.g., surface mount technology (SMT) pads.

During operation, the primary and target PCBs 22, 24 are moved into position so that the PCBs 22, 24 are substantially perpendicular to each other as shown in FIG. 1. At this point, the connectors 26 are reliably fastened to the primary PCB 22 (e.g., using hardware), and electrically connected to the primary PCB 22 (e.g., via the contacts 32 and the PTHs 34). Additionally, the target PCB 24 is precisely aligned with the primary PCB 22 and the connectors 26 so that the contacts 34 appropriately face corresponding contacts 42 of the target PCB 24. Such positioning of the PCBs 22, 24 can be facilitated using mechanical supporting structures and hardware which reliably and precisely hold the PCBs physically in place. An example of such a mechanical supporting structure is the framework which mounts a device under test (DUT) board to a test equipment interface (or an interposer) in the context of automated test equipment (ATE).

Next, to electrically connect the connectors 26 to the target PCB 24, the controller 28 provides mechanical actuation 50 to the actuation mechanisms 36 of the connectors 26. For simplification, the controller 28 is represented in block diagram form and the mechanical actuation 50 is illustrated as an arrow. However, it should be understood that the controller 28 includes control circuitry 52 and electromechanical actuators 54 controlled by the control circuitry 52. For example, through a hole or actuation tab defined by each actuation mechanism 36, a rod can be inserted/attached (i.e., along the Z-axis) and then translated in the positive X-direction by the actuators 54 in response to electrical signals from the control circuitry 52.

In response to the mechanical actuation 50, the actuation mechanisms 36 of the connectors 26 establish electrical connection with the target PCB 24. In particular, the contacts 34 of the connectors 26 gently but reliably scrub against the contacts 42 of the target PCB 24 in a direction toward the target PCB 24 (e.g., the positive X-direction) for consistent and robust electrical connectivity. Accordingly, with minimal wiping force, the contacts 34 of the connectors 26 make electrical contact with the contacts 42 of the target PCB 24.

To electrically disconnect the connectors 26 from the target PCB 24, the controller 28 again provides actuation 50 (i.e., the control circuitry 52 drives the actuators 54), but this time, such actuation 50 moves the actuation mechanisms 36 of the connectors 26 in the reverse direction. In response to this subsequent actuation, the contacts 34 of the connectors 26 gently retract from the contacts 42 of the target PCB 24 (e.g., the negative X-direction). As a result, the PCBs 22, 24 can now be physically separated from each other and the various components can be inspected, serviced, replaced, etc.

It should be understood that, while the contacts 34 of the connectors 26 are retracted, the contacts 34 are well-protected against damage by the connector bodies 30 of the connectors 26. Additionally, due to the minimal wiping force between the connector contacts 34 and the contacts 42 of the target PCB 42, there is minimal wear thus enabling electrical connection and disconnection to be repeated (perhaps frequently) without substantially wearing down components. Further details will now be provided with reference to FIG. 2.

Figure 2:
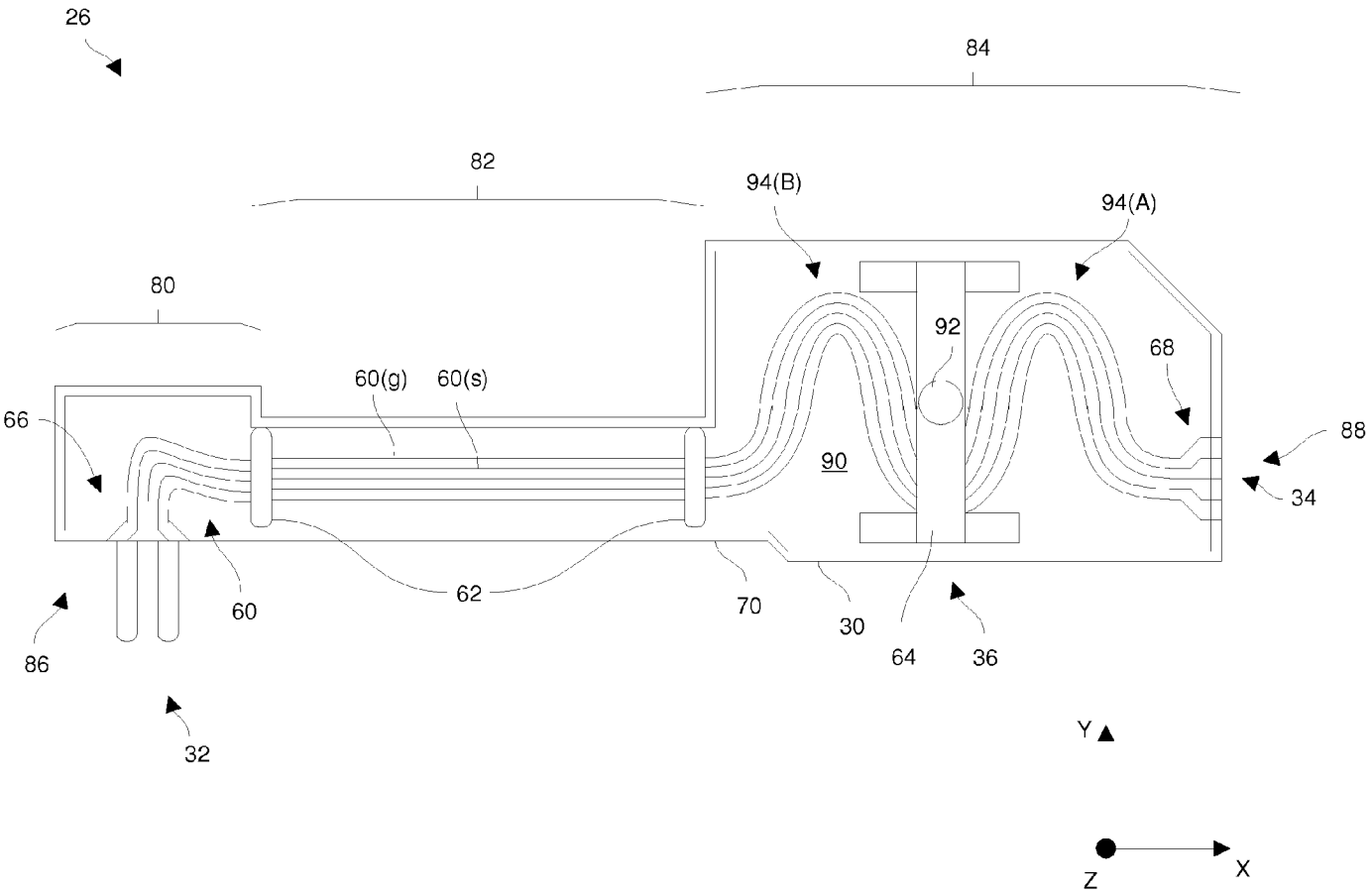
FIG. 2 is a cross-sectional side view of a zero-insertion wiping force connecting devices of the electronic system of FIG. 1.

FIG. 2 is a cross-sectional side view of a connector 26 of the electronic system 20. The connector 26 further includes a set of compliant conductors 60, conductor supports 62, and a movable member 64. Each compliant conductor 60 is formed from metallic material (e.g., beryllium copper or similar material), and has a first end 66 which terminates at the contacts 32 and a second end 68 which forms a respective contact 34. Dimensionally, the compliant conductors 60 have cross-sectional geometries and distances relative to other compliant conductors 60 which are similar to PCB signal traces. Accordingly, each compliant conductor 60 provides a reliable signal pathway with impedance characteristics similar to those of PCB traces.

It should be understood that portions of the compliant conductors 60 have a wave-shape or S-shape. In particular, each compliant conductor 60 defines a series of smooth curves between the first end 66 and the second end 68. Preferably, the compliant conductors 60 do not bend out of the X-Y plane in the Z-direction. As will be described in further detail shortly, this feature enables different parts of the compliant conductors 60 to undergo subtle compression/tension changes.

The connector body 30 protects the compliant conductors 60, holds the conductor supports 62 in place, and restricts movement of the movable member 64 to linear translation along the axis extending between the mounting location and the interface location of the connector 26 (i.e., along the X-axis in FIG. 2). Preferably, the connector body 30 includes a metallic coating (or barrier) 70 which encapsulates the compliant conductors 60 for robust and reliable electromagnetic interference (EMI) shielding. Additionally, the connector body 30 can couple to a ground reference of the primary PCB 22 for safety purposes.

In some arrangements, the connector 26 includes five compliant conductors 60, i.e., three grounding/baseline compliant conductors 60(*g*) and two signal compliant 60(*s*) conductors which are disposed in an interleaved/alternating manner. Such an arrangement is suitable for differential signals and broadside coupling. It should be understood that some of the compliant conductors 60 can optionally connect to the metallic coating 70 rather than a respective contact 32. For example, as shown in FIG. 2, the grounding/baseline compliant conductors 60(*g*) can connect to the metallic coating 70 of the connector body 30 while only, the signal compliant conductors 60(*s*) carry data signals and thus connect to the contacts 32 (e.g., pins) leading to the primary PCB 22. Alternatively, the grounding/baseline conductors 60 also connect to the contacts 32 (e.g., pins) leading to the primary PCB 22.

The conductor supports 62 stabilize the compliant conductors 60. In some arrangements, the conductor supports 62 are integrated (i.e., unitary) with the connector body 30 of the connector 26. For example, portions of the connector body 30 and/or the conductor supports 62 can be formed from plastic (injection molded, tooled, etc.) using a variety of techniques.

As shown in FIG. 2, the connector body 30 divides the connector 26 into essentially three sections, namely, a base section 80, a middle section 82, and an interface section 84. The base section 80 holds the first ends 66 of the compliant conductors 60 and the contacts 32 (e.g., pins) at a mounting location 86 which mounts to the primary PCB 22. The middle section 82 supports the compliant conductors 60. The interface section 84 houses the movable member 64, and constrains and protects the ends 68 of the compliant conductors 60 at an interface location 88. In some arrangements, the ends 68 remain substantially flush with the surface of the connector body 30.

The movable member 64, which forms part of the actuation mechanism 36 (also see FIG. 1), is constructed and arranged to translate linearly within an internal chamber (or cavity) 90 of the connector body 30. To this end, the movable member 64 defines a hole (or tab) 92 which enables convenient capturing and actuation of the movable member 64 (e.g., by an actuator, rod or bar). That is, the movable member 64 is capable of sliding along the X-axis within the interface section 84 of connector body 30, and the walls of the connector body 30 restrict the movable member 64 in other directions.

The movable member 64 holds a mid-section of the wave-shaped portion of the compliant conductors 60 in proper spatial separation relative to each other for electrical isolation (i.e., air insulation) as well as for controlled signal integrity purposes (e.g., impedance control). Such a spatial relationship between compliant conductors 60 is well-suited for broadside coupling.

Furthermore, as the movable member 64 moves along the X-axis, the movable member 64 adjusts tension within the compliant conductors 60. Accordingly, the movable member 64 is able to change (e.g., tune) the signal characteristics of the compliant conductors 60 by translating along the X-axis within the interface section 84. For example, moving the movable member 64 in the positive X-direction provides compression on portions 94(A) of the compliant conductors 60 and opposite tension on portions 94(B) of the compliant conductors 60. As a result, such movement is able to modify the amount of scrubbing which is performed by the ends 68 of the compliant conductors 60 at the interface location 88, as well as adjust the electrical characteristics between the compliant conductors 60 due to minute positioning changes.

It should be understood that the movement of the ends 68 relative to the connector body 30 and the contacts 42 of the target PCB 24 does not need to be linear. Rather, the ends 68 can be constructed and arranged to roll over tabs or pass through grooves of the connector body 30 so that the ends 68 move in an arc or so that the ends 68 have an angular component which is not perpendicular to the contacts 42 of the target PCB 24. As a result, effective and efficient wiping occurs between the ends 68 and the contacts 42, but the wiping force is minimal thus reducing wear and tear on the connecting components. Further details will now be provided with reference to FIG. 3.

Figure 3:
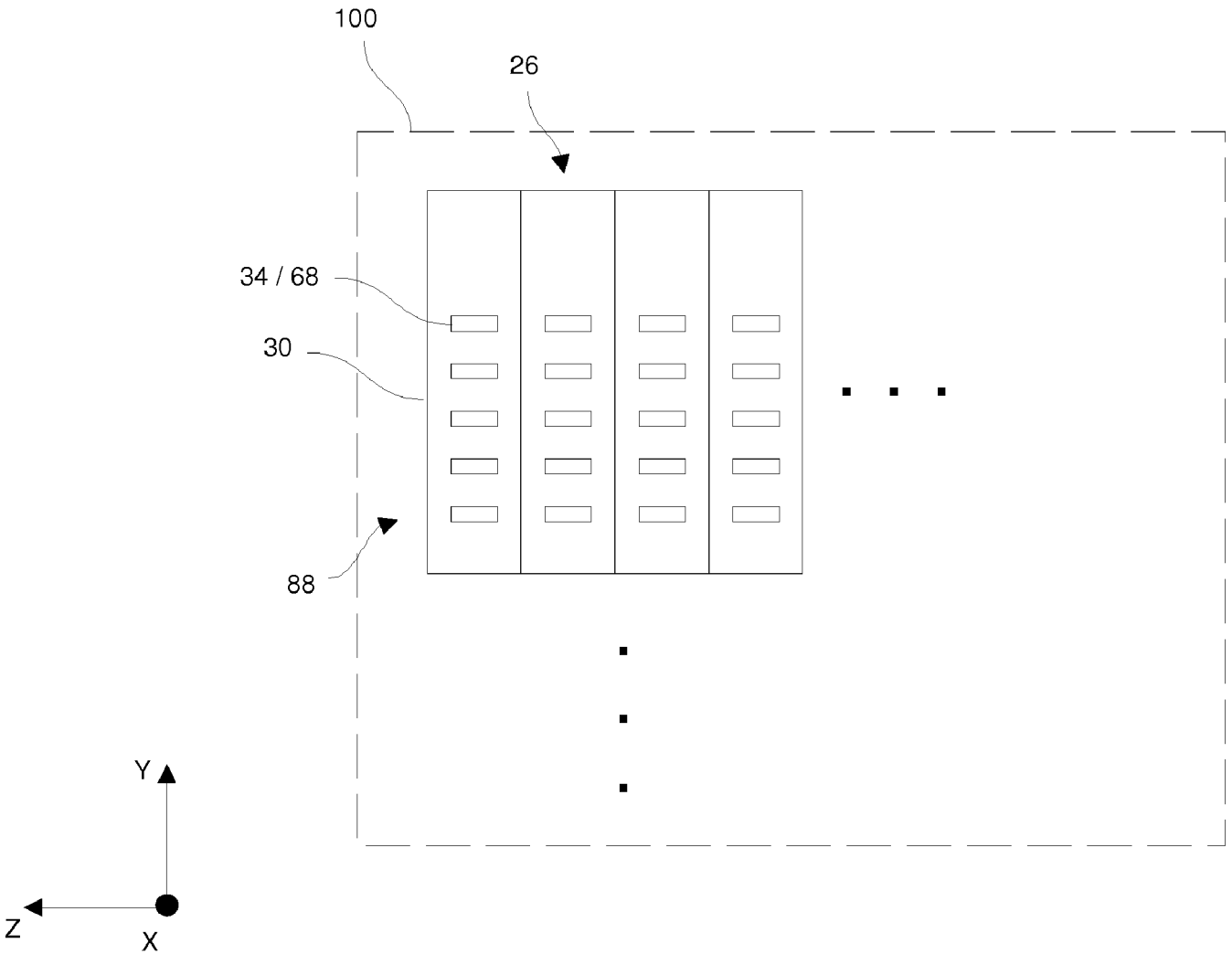
FIG. 3 is a view of a connection interface formed by the zero-insertion wiping force connecting devices of FIG. 1.

FIG. 3 shows a connection interface 100 which is formed by aligning the interface locations 88 (FIG. 2) of multiple connectors 26 end-to-end. Accordingly, the contacts 34 form a two-dimensional array of connector contacts. Such an arrangement provides the ability to move many signals from one circuit board (e.g., the primary PCB 22) to another circuit board (e.g., the target PCB 24) in a high density manner. In terms of circuit board real estate, only the footprint of the two-dimensional array is consumed for corresponding circuit board contacts 42 (FIG. 2).

As best seen in FIG. 2, the ends 68 of the compliant conductors 60 are constrained by the connector body 30 at the interface location 88. In particular, each end 68 is substantially flush with the connector body 30. Accordingly, the ends 68 remain well protected against damage (e.g., uncontrolled movement/activity external to the connector 26). Additionally, when the connector body 30 abuts the connection location of the target PCB 24 (also see the dashed area in FIG. 1), the ends 68 are able to conveniently make contact with the corresponding contacts 42 of the target PCB 24 in response to actuation of the actuation mechanism 36.

By way of example only, each connector 26 provides a column (or row) of five contacts 34, i.e., ends 68 of compliant conductors 60 (FIG. 2). Other numbers of contacts 34 are suitable for use as well (e.g., four, six, eight, etc.). Accordingly, the number of contacts 34 in the array can be increased by including more contacts 34 in each connector 26 and/or by adding connectors 26. Moreover, connectors 26 may be mounted to both sides of a single circuit board thus potentially doubling the number of contacts 34.

In this efficient and organized manner, the array of the connection interface 100 may be configured to have a fine pitch so that a large number of signals can be conveniently transferred between the perpendicularly oriented PCBs 22, 24 (e.g., 48, 72, 100, etc.). Further details will now be provided with reference to FIG. 4.

Figure 4:
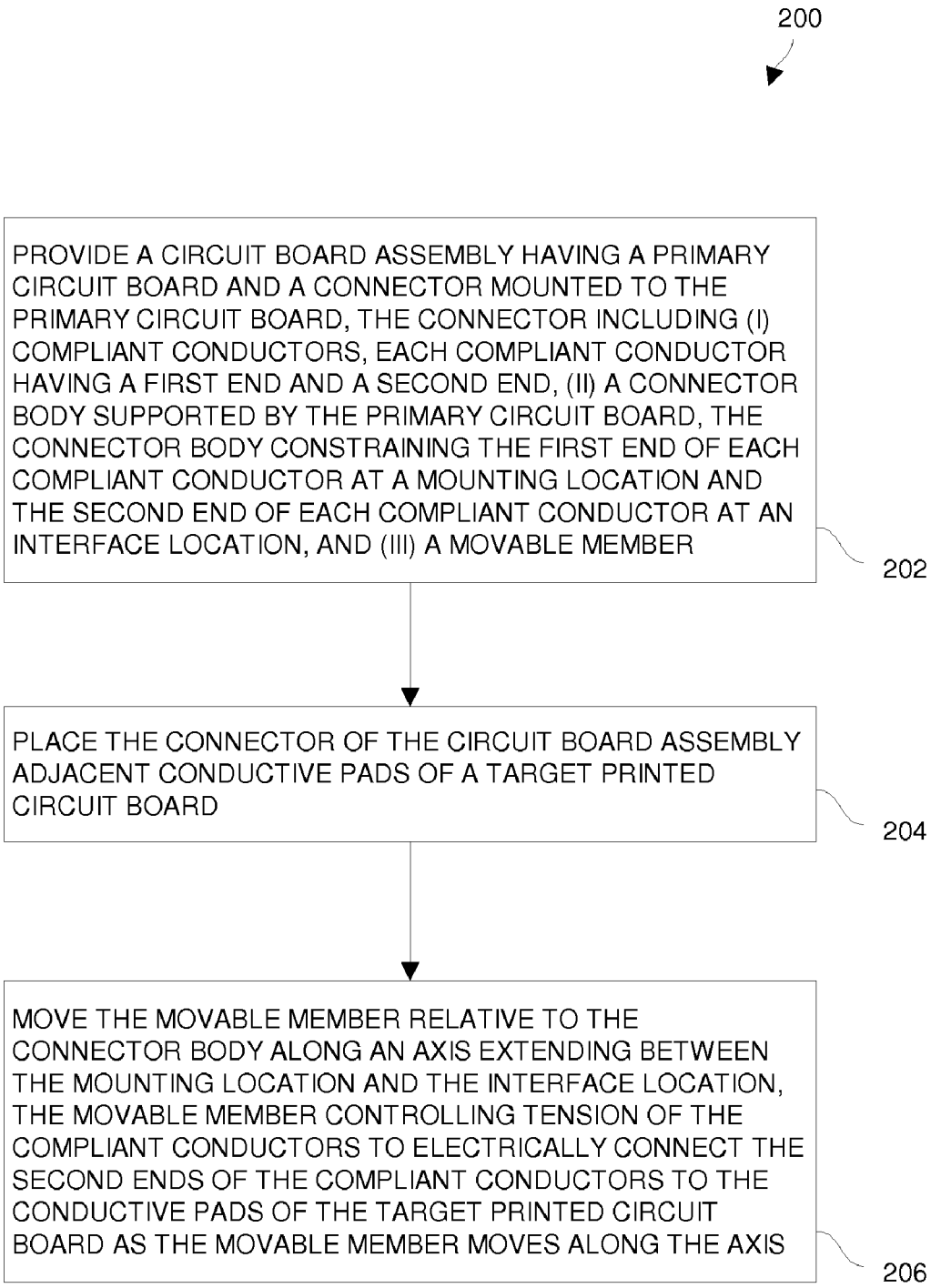
FIG. 4 is a flowchart of a procedure which involves the use of the zero-insertion wiping force connecting devices of FIG. 1.

FIG. 4 is a flowchart of a procedure 200 which involves the use of the connectors 26 to establish connections between the PCBs 22, 24 (also see FIGS. 1-3). In the context of ATE, the procedure 200 may be performed when preparing the ATE to test a series of devices (e.g., integrated circuits (ICs), packaged ICs, IC modules, circuit boards, etc.).

In step 202, a user provides a circuit board assembly having the primary PCB 22 and a set of connectors 26 mounted to the primary PCB 22. As described earlier, each connector 26 includes compliant conductors 60, a connector body 30 supported by the primary PCB 22, and a movable member 64 that moves within the connector body 30.

In step 204, the user places the set of connectors 26 of the circuit board assembly adjacent contacts 42 of a target PCB 24 (e.g., SMT pads), also see FIG. 1. This step may involve the use of mechanical support structures to securely hold and align the PCBs 22, 24 relative to each other.

In step 206, the user moves the movable member 64 relative to the connector body 30 of each connector 26. In particular, the user controls the movable member 64 using a controller 28 (i.e., the control circuitry 52 in combination with the electromechanical actuators 54) to control tension of the compliant conductors 60. Accordingly, the ends 68 of the compliant conductors 60 electrically connect to the contacts 42 of the target PCB 24. In some arrangements, the compliant conductor ends 68 move toward the contacts 42 in a direction which is non-parallel to X-axis of FIGS. 1 and 2) to provide effective wipe with minimal force.

It should be understood that the movable member 64 can be actuated in the reverse direction as well. For example, suppose that the primary PCB 22 is a relatively sensitive and critical portion of an ATE system, and that the target PCB 24 is a DUT board which requires replacement. Here, the user (controlling the actuation mechanism 36 using the controller 28, FIG. 1) moves the movable member 64 in the opposite direction (i.e., away from the interface location 88, FIG. 2). As a result, the ends 68 retract so that they are again flush with the surface of the connector body 30 and are thus well-protected.

As described above, improved connecting techniques utilize a ZiWF connecting device to connect two circuit boards. In this context, ZiWF represents a wiping force that is minimal thus lowering wear and tear on the connecting components. Such a ZiWF connector requires little if any force to establish a robust and reliable electrical connection. As a result, there is less wear on the connector and less strain between the connector and the circuit board thus improving reliability and longevity among the various components.

While various embodiments of the invention have been particularly shown and described, it will be understood by those skilled in the art that various changes in form and details may be made therein without departing from the spirit and scope of the invention as defined by the appended claims.

For example, the controller 28 was described above as being electronically-based. In some arrangements, the controller 28 may probe the electrical characteristics of the compliant conductors 60 (e.g., through the primary PCB 22 and/or the target PCB 24) and make fine adjustments to the movable member 64 based on such probing. In other arrangements, the controller 28 is programmed to simply switch between two positions, i.e., a connect position in which the ends 68 connect to the contacts 42 of the target PCB 24 and a disconnect position in which the end retract away from the contacts 42 of the target PCB 24. As yet another alternative, the movable member 64 is manually actuated by a user. Such modifications and enhancements are intended to belong to various embodiments of the electronic system 20.

What is claimed is:

1. A printed circuit board connector, comprising:

compliant conductors, each compliant conductor having a first end and a second end;

a connector body which constrains the first end of each compliant conductor at a mounting location and the second end of each compliant conductor at an interface location; and a movable member which is capable of moving relative to the connector body along an axis extending between the mounting location and the interface location, the movable member being constructed and arranged to control tension of the compliant conductors while the connector body constrains the first end of each compliant conductor at the mounting location and the second end of each compliant conductor at the interface location.

2. A printed circuit board connector as in claim 1 wherein the connector body includes:

a base portion which holds the first ends of the compliant conductors in positions to connect with a connector mounting location of a printed circuit board; and an interface portion coupled to the base portion, the interface portion (i) defining a flat surface and (ii) holding the second ends of the compliant conductors substantially flush with the flat surface to provide protection to the second ends of the compliant conductors.

3. A printed circuit board connector as in claim 2 wherein the interface portion of the connector body arranges the second ends of the compliant conductors in a column to form a portion of a two-dimensional array of connector contacts.

4. A printed circuit board connector as in claim 3 wherein each compliant conductor defines a series of smooth curves in a direction along the axis extending between the mounting location and the interface location.

5. A printed circuit board connector as in claim 4 wherein the movable member contacts a mid-section of each compliant conductor, the movable member being constructed and arranged to compress one-side of each compliant conductor in response to translation along the axis extending between the mounting location and the interface location while concurrently maintaining electrical isolation between the compliant conductors.

6. A printed circuit board connector as in claim 5 wherein the second end of each compliant conductor is constructed and arranged to move in direction which is non-parallel to the axis extending between the mounting location and the interface location.

7. A printed circuit board connector as in claim 3 where each compliant conductor has a rectangular cross-section; and wherein the compliant conductors run in a substantially parallel manner relative to each other.

8. A printed circuit board connector as in claim 7 wherein the connector body defines an internal chamber to provide air insulation between neighboring compliant conductors of the compliant conductors.

9. A printed circuit board connector as in claim 8 wherein the compliant conductors reside in a spatial relationship which is constructed and arranged to provide broadside coupling.

10. A printed circuit board connector as in claim 8 wherein the connector body includes a layer of conductive material which substantially encapsulates the compliant conductors.

11. A circuit board assembly, comprising:

a primary printed circuit board; and a printed circuit board connector mounted to a mounting location of the primary printed circuit board, the printed circuit board connector including:

compliant conductors, each compliant conductor having a first end and a second end, a connector body supported by the primary printed circuit board, the connector body constraining the first end of each compliant conductor at the mounting location and the second end of each compliant conductor at an interface location, and a movable member which is capable of moving relative to the connector body along an axis extending between the mounting location and the interface location, the movable member being constructed and arranged to control tension of the compliant conductors while the connector body constrains the first end of each compliant conductor at the mounting location and the second end of each compliant conductor at the interface location.

12. A circuit board assembly as in claim 11, further comprising:

a target printed circuit board having conductive pads which electrically connect to the second ends of the compliant conductors at the interface location when the primary printed circuit board is oriented in a substantially perpendicular manner relative to the target printed circuit board.

13. A circuit board assembly as in claim 12 wherein the primary printed circuit board forms a portion of an automated test equipment system; and wherein the target printed circuit board is a device interface board which operates as an interface between the automated test equipment system and a device under test.

14. A connection method, comprising:

providing a circuit board assembly having a primary printed circuit board and a connector mounted to the primary printed circuit board, the connector including (i) compliant conductors, each compliant conductor having a first end and a second end, (ii) a connector body supported by the primary printed circuit board, the connector body constraining the first end of each compliant conductor at a mounting location and the second end of each compliant conductor at an interface location, and (iii) a movable member;

placing the connector of the circuit board assembly adjacent conductive pads of a target printed circuit board; and moving the movable member relative to the connector body along an axis extending between the mounting location and the interface location, the movable member controlling tension of the compliant conductors to electrically connect the second ends of the compliant conductors to the conductive pads of the target printed circuit board as the movable member moves along the axis.

* * * * *